US008893410B2

(12) United States Patent
Vrdoljak et al.

(10) Patent No.: US 8,893,410 B2
(45) Date of Patent: Nov. 25, 2014

(54) FABRIC CARE APPLIANCE

(75) Inventors: Ognjen Vrdoljak, Laval (CA); James Russell Varney, Maynard, MA (US); Mark Rosenzweig, Chestnut Hill, MA (US); Peggy Lam, Randolph, MA (US)

(73) Assignee: Euro-Pro Operating LLC, Newton, MA (US)

( * ) Notice: Subject to any disclaimer, the term of this patent is extended or adjusted under 35 U.S.C. 154(b) by 574 days.

(21) Appl. No.: 12/723,623

(22) Filed: Mar. 12, 2010

(65) Prior Publication Data

US 2011/0219646 A1 Sep. 15, 2011

(51) Int. Cl.

| | |
|---|---|
| ***D06F 75/18*** | (2006.01) |
| ***D06F 75/38*** | (2006.01) |
| ***D06F 75/16*** | (2006.01) |
| *D06F 75/30* | (2006.01) |

(52) U.S. Cl.

CPC ..... *D06F 75/30* (2013.01); *D06F 75/16* (2013.01)

USPC ..... 38/77.8; 38/77.83; 38/93; 38/88; 68/222; D32/17

(58) Field of Classification Search

CPC ..... D06F 75/00; D06F 75/08; D06F 75/10; D06F 75/18; D06F 75/20; D06F 75/22; D06F 75/30; D06F 75/38; D06F 87/00

USPC ..... 219/246, 259, 250, 251, 254, 255; 38/14, 69, 71, 141, 74–97

See application file for complete search history.

(56) References Cited

U.S. PATENT DOCUMENTS

| | | | | | |
|---|---|---|---|---|---|
| 2,674,819 | A | * | 4/1954 | Zastrow et al. | 38/77.3 |
| 2,713,225 | A | * | 7/1955 | Wolcott | 38/99 |
| 2,743,542 | A | * | 5/1956 | Drummond | 38/97 |
| 2,970,394 | A | * | 2/1961 | Brumbaugh | 38/77.9 |
| 3,001,305 | A | * | 9/1961 | Sardeson | 38/77.5 |
| 3,071,879 | A | * | 1/1963 | Blank | 38/77.9 |
| 3,077,900 | A | * | 2/1963 | Ehrmann et al. | 239/407 |
| 3,110,975 | A | * | 11/1963 | Kircher | 38/77.7 |
| D222,502 | S | | 10/1971 | Madl et al. | |
| 3,620,055 | A | | 11/1971 | Blachly et al. | |
| 3,690,024 | A | * | 9/1972 | Osrow | 38/69 |
| D229,016 | S | | 11/1973 | Plasko | |
| D229,664 | S | | 12/1973 | Stutzer | |
| 3,805,425 | A | | 4/1974 | Spoida et al. | |
| 4,716,276 | A | * | 12/1987 | Motegi et al. | 219/253 |
| 5,224,237 | A | | 7/1993 | Ambrosiano | |

(Continued)

FOREIGN PATENT DOCUMENTS

| | | | |
|---|---|---|---|
| CN | 101082173 | A | 12/2007 |
| JP | 2001-204997 | A | 7/2001 |
| KR | 10-1998-0074275 | A | 11/1998 |

OTHER PUBLICATIONS

International Search Report and Written Opinion for PCT/US2011/026459 mailed Nov. 22, 2011.

(Continued)

*Primary Examiner* — Ismael Izaguirre

(74) *Attorney, Agent, or Firm* — Wolf, Greenfield & Sacks, P.C.

(57) ABSTRACT

Appliances, methods and systems in which steam can be applied to a fabric and a heated surface can be used to press and/or dry the fabric.

23 Claims, 4 Drawing Sheets

(56) References Cited

U.S. PATENT DOCUMENTS

| | | | | |
|---|---|---|---|---|
| 5,590,439 | A | 1/1997 | Alazet | |
| 5,651,201 | A * | 7/1997 | Farley | 38/88 |
| 5,987,788 | A * | 11/1999 | Doyel | 38/97 |
| 6,009,645 | A * | 1/2000 | Shimizu et al. | 38/77.5 |
| D426,924 | S | 6/2000 | Joiner et al. | |
| D436,424 | S | 1/2001 | Buzzi | |
| 6,275,653 | B1 | 8/2001 | Montipo' | |
| 6,438,876 | B2 * | 8/2002 | Har et al. | 38/77.7 |
| D465,309 | S | 11/2002 | Foersterling | |
| 6,499,519 | B1 * | 12/2002 | Brown | 150/161 |
| 6,513,269 | B2 * | 2/2003 | Kobayashi et al. | 38/93 |
| D473,987 | S | 4/2003 | Foersterling | |
| 6,986,217 | B2 | 1/2006 | Leung et al. | |
| 7,155,117 | B2 | 12/2006 | Leung et al. | |
| 7,380,556 | B2 * | 6/2008 | Carballada et al. | 132/224 |
| 7,475,504 | B2 | 1/2009 | Leung | |
| 7,490,422 | B1 * | 2/2009 | Chen | 38/75 |
| D589,663 | S | 3/2009 | Massip et al. | |
| 7,516,565 | B1 * | 4/2009 | Tsen | 38/77.1 |
| D595,461 | S | 6/2009 | Massip et al. | |
| D601,806 | S | 10/2009 | Choi | |
| D601,807 | S | 10/2009 | Choi | |
| 7,661,212 | B2 * | 2/2010 | Hahn | 38/81 |
| D611,208 | S | 3/2010 | Lam | |
| 7,673,404 | B2 * | 3/2010 | Guohong | 38/77.83 |
| 7,721,474 | B2 * | 5/2010 | Jiang et al. | 38/77.7 |
| D620,208 | S | 7/2010 | Mangano | |
| D620,651 | S | 7/2010 | Enervold | |
| D622,457 | S | 8/2010 | Choi | |
| 8,365,447 | B2 | 2/2013 | Rosenzweig et al. | |
| 2008/0066789 | A1 * | 3/2008 | Rosenzweig et al. | 134/106 |
| 2009/0000162 | A1 | 1/2009 | Guohong | |
| 2011/0030249 | A1 | 2/2011 | Rosenzweig et al. | |

OTHER PUBLICATIONS

[No Author Listed] Deluxe Hand Held Fabric Steamer. CONAIR. Amazon.com. Printed Mar. 5, 2010. 2 pages.

* cited by examiner

FABRIC CARE APPLIANCE

FIELD OF THE INVENTION

The invention relates generally to fabric care appliances, and more specifically to appliances which emit steam and include a heating surface.

DISCUSSION OF RELATED ART

Garment steamers are often used to smooth wrinkles in clothing or other fabrics, and also as a way of freshening clothes between cleanings. Typically, a handheld portion of garment steamer releases steam toward a target fabric, and the steam relaxes the fibers in the fabric. In some steamers, the steam is emitted from a nozzle, and in other steamers, the steam is emitted from holes in a flat metal plate.

SUMMARY

Embodiments of the invention provided herein are directed to appliances, methods and systems in which steam can be applied to a fabric and a heated surface can be used to press and/or dry the fabric.

According to one embodiment of the invention, a fabric care appliance system comprises an appliance body including a steam outlet configured to emit steam from the appliance, a heatable pressing surface configured such that no steam passes through the heatable pressing surface, and a first heating element configured to heat the heatable surface.

According to another embodiment of the invention, a fabric care appliance system comprises an appliance body including a steam outlet configured to emit steam from the appliance, a rigid heatable surface, and a first heating element configured to heat the rigid heatable surface. The system also includes a steam-permeable fabric positionable over the steam outlet such that steam permeates through the steam-permeable fabric when the steam is emitted from the appliance.

According to a further embodiment of the invention, a fabric care appliance system comprises an appliance body including a heatable pressing surface which extends outwardly from the appliance body, a first heating element configured to heat the heatable pressing surface, and a steam outlet configured to emit steam from the appliance, the steam outlet being positioned at a distance from the heatable pressing surface. The heatable pressing surface and the steam outlet are constructed and arranged such that when the heatable pressing surface is contacted to a fabric surface, the steam outlet is positioned at a distance away from the fabric surface.

According to another embodiment of the invention, a fabric care appliance system comprises an appliance body including a heatable pressing surface, a first heating element configured to heat the heatable pressing surface, and a steam outlet configured to emit steam from the appliance. The system also includes a steam generator including a second heating element, the second heating element being distinct from the first heating element.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF DRAWINGS

The accompanying drawings are not intended to be drawn to scale. For purposes of clarity, not every component may be labeled in every drawing. In the drawings.

DETAILED DESCRIPTION

Figure 1:
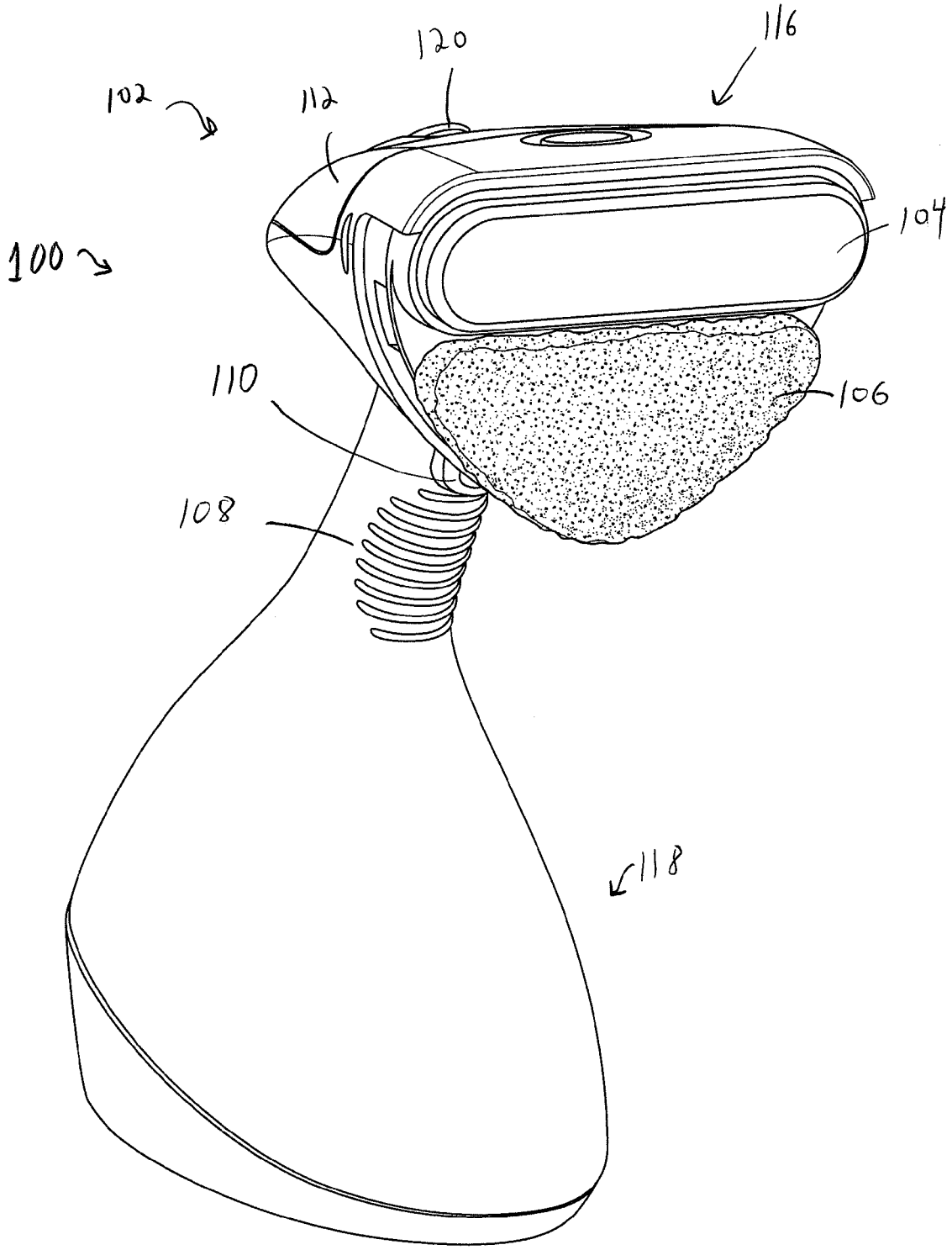
FIG. 1 is a perspective view of a fabric care appliance with a steam-permeable fabric mounted over a steam outlet according to one embodiment.

Various aspects of the invention are described below and/or shown in the drawings. These aspects of the invention may be used alone and/or in any suitable combination with each other. Aspects of the invention are not limited in any way by the illustrative embodiments shown and described herein. In addition, it should be understood that aspects of the invention may be used alone or in any suitable combination with other aspects of the invention.

Embodiments of the invention provided herein are directed to fabric care appliances which may be used to freshen and press various fabrics with a handheld steam and heat applicator. For example, a fabric care appliance may be used to apply steam to garments, upholstery, drapes, etc., while additionally pressing the target fabric with a heated surface. According to one aspect of the disclosure, the surface may be heated by a heating element which is separate from a heating element that heats a steam generator. In some embodiments, the fabric care appliance may be entirely contained within a single handheld unit. Additionally, several different attachments may be provided for the appliance so that an attachment which is well-suited to a particular task may be used.

Known garment steamers which apply only steam to fabrics can be useful in many situations. Such steamers often include a handheld unit which is configured to deliver steam to a fabric via a steam nozzle or other steam outlet. However, for smoothing wrinkles and giving fabrics a crisp look, application of steam alone may provide only temporary wrinkle reduction. In some cases, once the fabric dries, some of the wrinkles may reappear.

In embodiments of fabric care appliances disclosed herein, a heating surface (e.g., a heating bar) and a steam outlet are separately provided on a handheld unit. With such an arrangement, as a user moves the handheld unit across the surface of garment (or other fabric), steam is applied to the garment, followed by a pressing action of the heating bar. The steam relaxes the fibers in the garment, and the heating bar stretches the fibers into a flattened state. Additionally, the heating bar may help to dry any residual moisture left by the steam. The application of steam also may help to remove odors and sanitize the fabric.

With the steam outlet being separate from the heating surface, a steam-permeable fabric may be placed over the steam outlet in some embodiments. The steam-permeable fabric may reduce or eliminate water spotting on a garment by blocking droplets of water from reaching the garment. By reducing undesired water spotting, a higher steam rate may be used in some embodiments as compared to other garment steamers.

A first heating element may be used to heat the heating surface, and a second, distinct heating element may be used as part of steam generation in some embodiments. In this manner, the heating of the heating surface may be controlled separately from the heating of the steam generator. Further, the heating surface can be controlled or designed to reach a particular temperature or temperature range without consideration of how the control of the heating element will affect steam generation.

Figure 2:
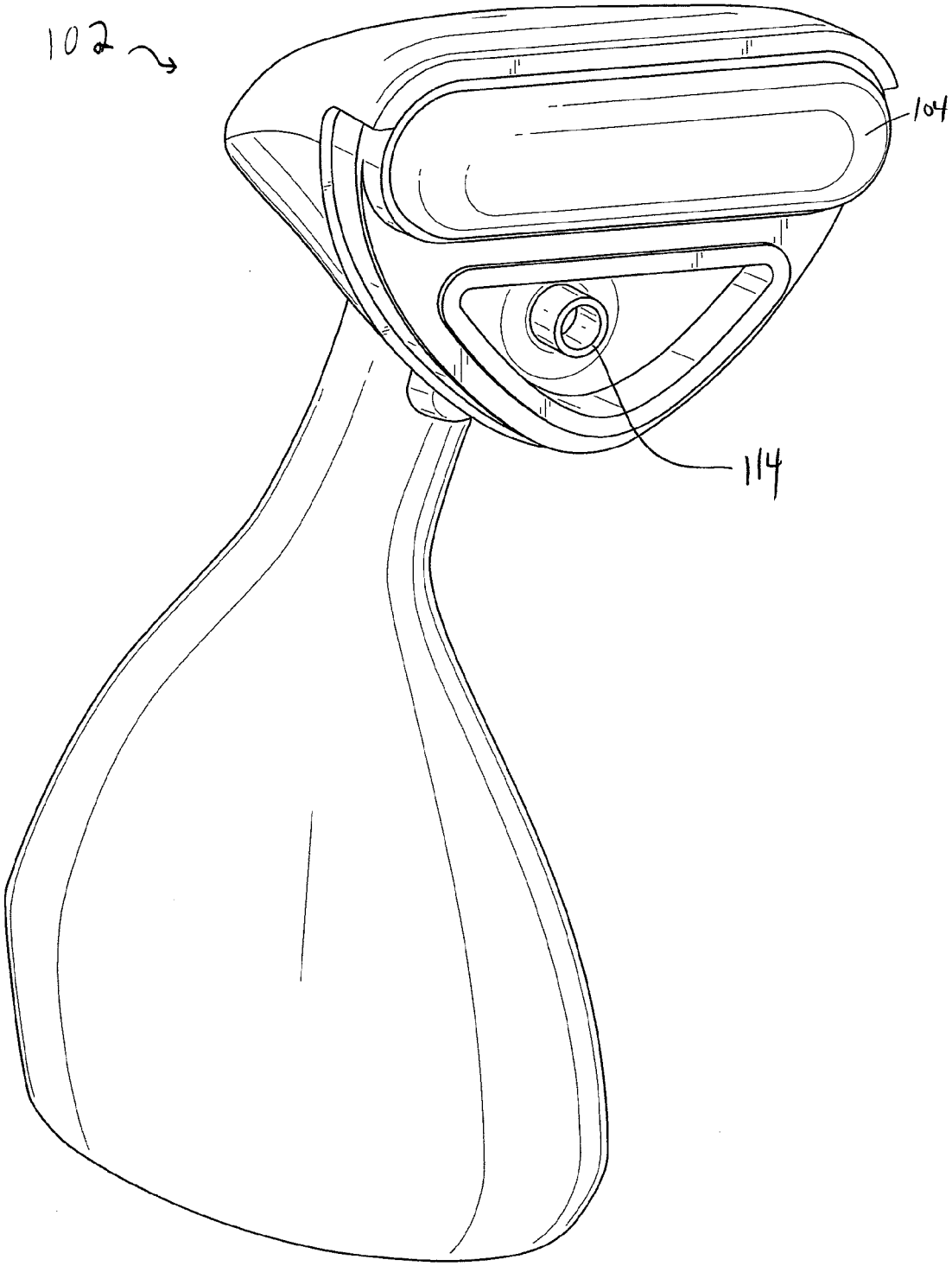
FIG. 2 shows the fabric care appliance of FIG. 1 with the steam-permeable fabric removed.

A fabric care appliance body 100 is shown in FIG. 1 with an operating head 102 including a heating bar 104 and a steam-permeable fabric 106 positioned over a steam outlet 114 (see FIG. 2). A hand grip area 108 is positioned below operating head 102 with convenient access to a trigger 110 which a user actuates to emit steam from the steam outlet.

A liquid reservoir 112 is provided in an upper region 116 of appliance body 102. Liquid reservoir 112 is typically filled with water, and during operation, the water is conducted to a source for generating steam, such as a flash boiler. Liquid reservoir 112 may have a capacity of approximately 200 ml in some embodiments, although any suitable volume may be used. Access to liquid reservoir 112 to add liquid may be provided with an opening covered by a flexible plastic closure element 120. Of course any suitable type of access closure may be provided.

A pump and a steam generator may be held within appliance body 102 in a lower region 118 of appliance body 102. By positioning components such as the pump and the steam generator in lower region 118, the center of gravity of the appliance may be kept low on the appliance body, for example, below hand grip area 108. In some embodiments, a liquid reservoir and/or a steam generator may be positioned in a unit that is separate from appliance body 102. For example, the liquid reservoir and the steam generator may be held in a floor unit or a separately-held unit, and a steam conduit may conduct steam to steam outlet 114.

By positioning of heating bar 104 (or other heating surface) on the same appliance body as steam outlet 114, but at least slightly separated from steam outlet 114, as a user moves the handheld unit across the surface of a fabric, steam is applied to the fabric, followed by a pressing action of heating bar 104. This dual action can be achieved with a single pass of appliance body 102 when the appliance body is moved in a direction where steam outlet 114 leads heating bar 104. Of course in some embodiments, a user may apply steam with steam outlet 114 to an area of a garment, and then in a distinct motion, return to the same garment area and apply the heating bar.

Heating bar 104 is shown as being above steam-permeable fabric 106 in FIG. 1, but heating bar may be positioned below steam-permeable fabric 106, or to the side of steam-permeable fabric 106. More than one steam outlet may be employed in some embodiments, and more than one heating surface, such as two distinct heating bars, also may be used.

In some steaming appliance, higher steam rates can sometimes lead to undesired water droplet emission due to incomplete boiling of the water. By positioning a steam-permeable fabric 106 over steam outlet 114, the emission of water droplets onto target materials can be reduced or avoided. In some embodiments, steam may be emitted from steam outlet 114 at a rate of 25 grams/minute.

With steam-permeable fabric 106 removed in the embodiment shown in FIG. 2, steam outlet 114 is visible. Fabric care appliance systems disclosed herein do not necessarily required steam-permeable fabric or structure for supporting steam-permeable fabric. In some embodiments, one or more steam outlets apply steam directly to target materials.

Figure 3:
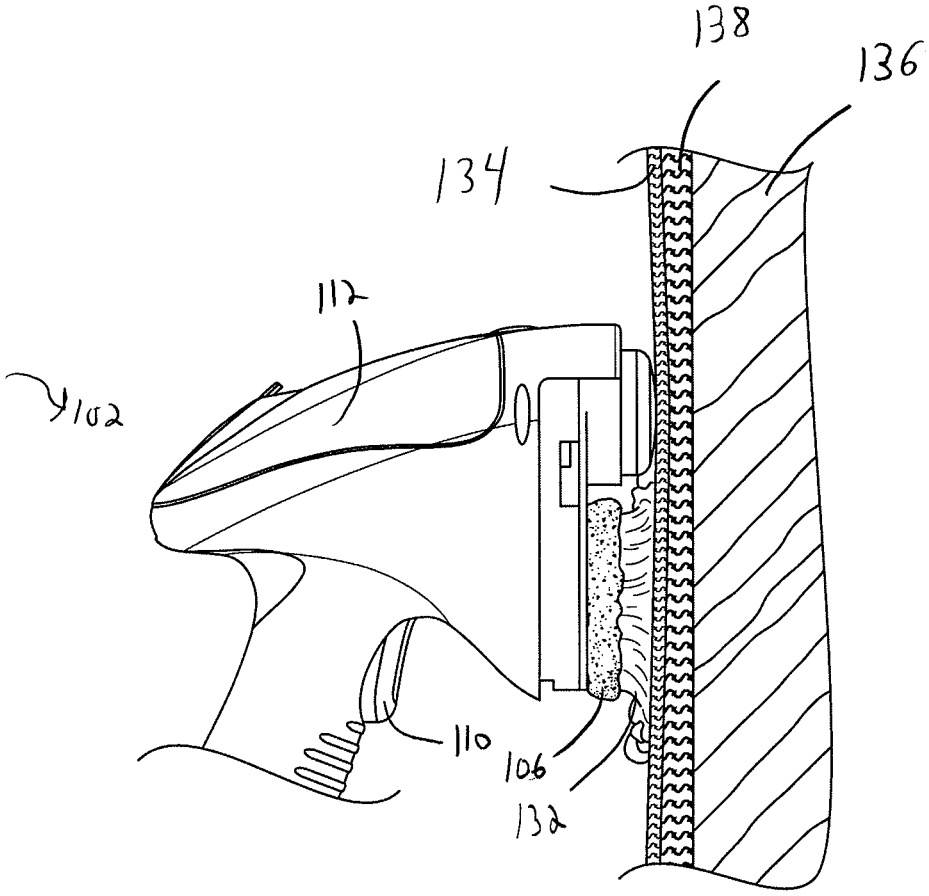
FIG. 3 is a side of a fabric care appliance applying steam and pressing a fabric.

As shown in FIG. 3, embodiments of the fabric care appliance disclosed herein may be used to apply steam 132 to a target fabric such as a garment 134, while simultaneously pressing garment 134 with a heating surface, such as heating bar 104. To help the user apply pressure to garment 134 with heating bar 104, garment 134 may hang vertically, for example, from a door 136. A pad 138 may be interposed between garment 134 and door 136 to protect garment 134 and door 136. Pad 138 may be a large pad made of quilted terry cloth or any other suitable material, and may include elastic elements for hanging the pad from a door.

When a vertical backing such as a door is not available or is not desired, weighted clips (not shown) may be provided to attach to the bottom of a hanging garment to provide tension in the garment, thereby allowing some pressure to be applied to the garment with heating bar 104.

As may be seen in FIG. 3, by positioning steam-permeable fabric 106 at a distance from garment 134, steam 132 has room to distribute over a larger area than if steam-permeable fabric were placed in contact with garment 134. Of course in some embodiments, steam-permeable fabric may be contacted directly to garment 134.

Heating bar 104 may be heated with a heating element that is distinct from a heating element that provides energy to the steam generator. For example, in some embodiments, heating bar 104 may be heated by a positive temperature co-efficient (PTC) heating element 138 (see FIG. 4), while the steam generator is heated with a resistance heating element, a separate PTC heating element, or any other suitable heating element. PTC heating element 138 may be configured to heat heating bar 104 to a temperature between 150 and 170 degrees Celsius, such as 160 degrees Celsius. Heating bar 104 may be constructed of die-cast, hard anodized aluminum in some embodiments. Of course other materials may be used such as polished aluminum, brushed aluminum, stamped aluminum, extruded aluminum, plated plastics, stainless steel, low carbon steel with non-stick coating, or other suitable materials.

Steam-permeable fabric may be formed with natural materials such as cotton, or synthetic materials. In some embodiments, steam-permeable fabric may be formed with a microfiber material.

Various accessories may be attached to appliance body 102. For example, a frame may be attachable which keeps the heating bar 104 separated from the target material by a distance. An upholstery brush may be attachable, such that brushes are provide below steam outlet 104. Additionally, a lint brush attachment may be provided.

Figure 4:
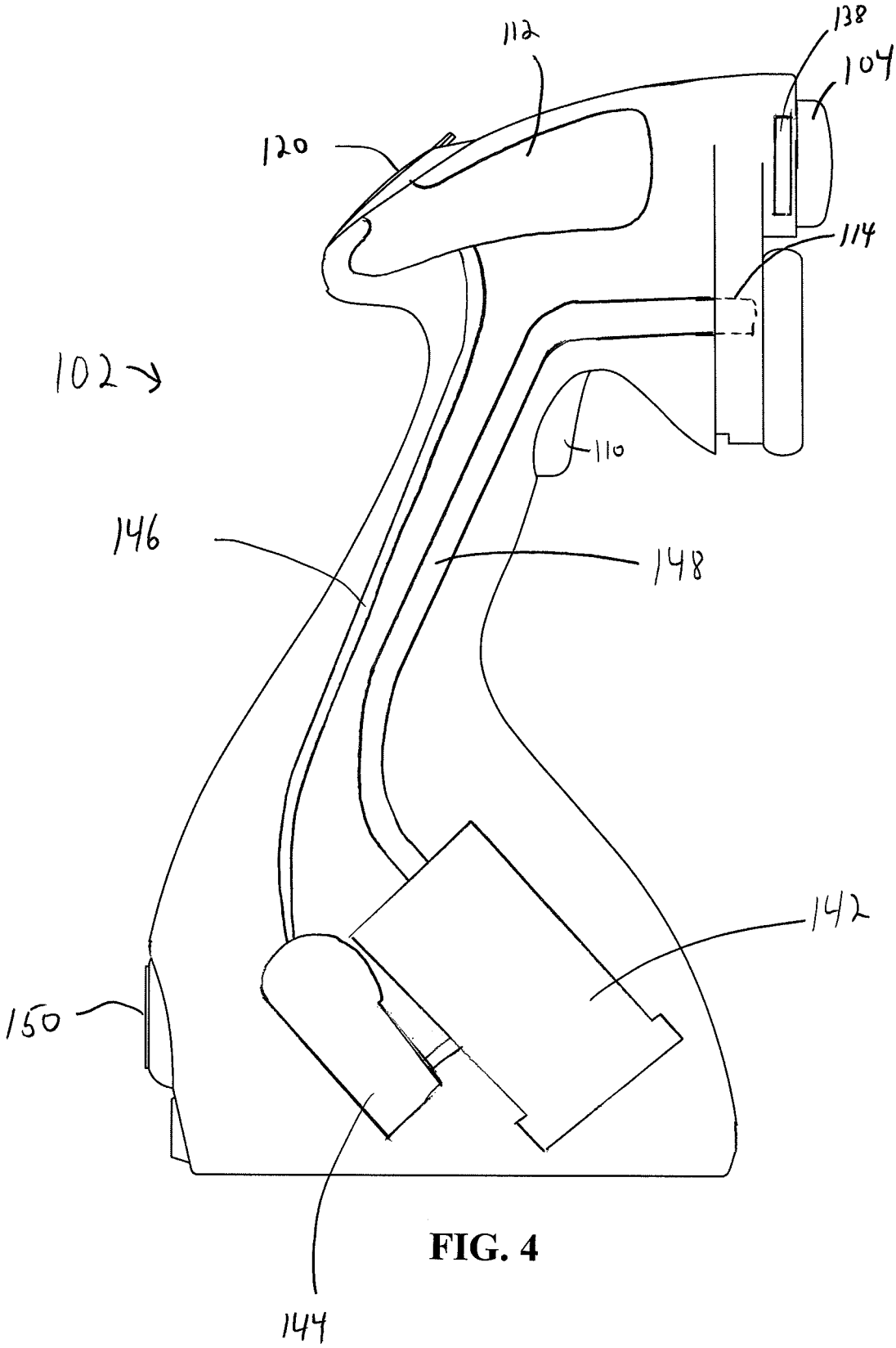
FIG. 4 shows the placement of various functional components with a fabric care appliance according to one embodiment.

One embodiment of an arrangement of components is shown in FIG. 4. A power switch 140 is provided on the bottom rear portion of appliance body 102. A steam generator 142 is positioned toward the front of appliance body 102. An electric liquid pump 144 moves water from reservoir 112 to steam generator 142 via a water conduit 146. Trigger 110 may be configured to activate pump 144. Steam produced by steam generator 142 is conducted to steam outlet 114 via a steam conduit 148. An on/off rocker switch 150 may be provided to activate the heater bar and the steam generator. The arrangement of components illustrated in FIG. 4 is but one example of possible component arrangements, including arrangements where one or more components are positioned in a unit separate from appliance body 102.

For purposes herein, the terms "connect", "connected", "connection", "attach", "attached" and "attachment" refer to direct connections and attachments, indirect connections and attachments, and operative connections and attachments.

Having thus described several aspects of at least one embodiment of this invention, it is to be appreciated various alterations, modifications, and improvements will readily occur to those skilled in the art. Such alterations, modifications, and improvements are intended to be part of this disclosure, and are intended to be within the spirit and scope of the invention. Accordingly, the foregoing description and drawings are by way of example only.

What is claimed is:

1. A fabric care appliance system comprising:

an appliance body including:

a steam outlet configured to emit steam from the appliance;

a heatable pressing surface separated in fixed relation from the steam outlet, wherein the heatable pressing surface and the steam outlet are constructed and arranged such that when the heatable pressing surface is contacted to a fabric surface, the steam outlet is positioned at a distance from the fabric surface and pointed toward the fabric surface; and a first heating element configured to heat the heatable surface; and a steam-permeable fabric positioned over the steam outlet.

2. A fabric care appliance system as in claim 1, further comprising a source to generate steam, the steam generation source including a second heating element that is distinct from the first heating element.

3. A fabric care appliance system as in claim 1, further comprising a liquid reservoir.

4. A fabric care appliance system as in claim 1, wherein the appliance body includes the steam generation source and a reservoir.

5. A fabric care appliance system as in claim 1, wherein the first heating element is configured such that the heatable pressing surface cannot exceed 200 degrees Celsius.

6. A fabric care appliance system as in claim 1, wherein the first heating element is configured to heat the heatable pressing surface to between 150 and 170 degrees Celsius.

7. A fabric care appliance system as in claim 1, wherein the heatable pressing surface has a convex curved shape.

8. A fabric care appliance system as in claim 1, wherein the heatable pressing surface has a width and a height, with the width being larger than the height, wherein the steam outlet is positioned adjacent to the width of the heatable pressing surface.

9. A fabric care appliance system as in claim 1, wherein the first heating element comprises a PTC heating element.

10. A fabric care appliance system comprising:

an appliance body including:

a steam outlet configured to emit steam from the appliance;

a rigid heatable pressing surface, wherein the heatable pressing surface and the steam outlet are constructed and arranged such that when the heatable pressing surface is contacted to a fabric surface, the steam outlet is positioned at a distance from the fabric surface and pointed toward the fabric surface; and a first heating element configured to heat the rigid heatable surface; and a steam-permeable fabric positionable over the steam outlet such that steam permeates through the steam-permeable fabric when the steam is emitted from the appliance.

11. A fabric care appliance system as in claim 10, further comprising a steam generator, the steam generator including a second heating element that is distinct from the first heating element.

12. A fabric care appliance system as in claim 11, wherein the steam generator is in the appliance body.

13. A fabric care appliance system as in claim 10, wherein the first heating element comprises a PTC heating element.

14. A fabric care appliance system as in claim 10, wherein the rigid heatable surface has a convex curved shape.

15. A fabric care appliance system comprising:

an appliance body including:

a heatable pressing surface which extends outwardly from the appliance body;

a first heating element configured to heat the heatable pressing surface; and a steam outlet configured to emit steam from the appliance body, the steam outlet being positioned at a distance from and in fixed relation to the heatable pressing surface; and a steam-permeable fabric positionable over the steam outlet;

wherein the heatable pressing surface and the steam outlet are constructed and arranged such that when the heatable pressing surface is contacted to a fabric surface, the steam outlet is positioned at a distance away from the fabric surface and pointed toward the fabric surface.

16. A fabric care appliance system as in claim 15, wherein the heatable pressing surface is configured such that no steam passes through the heatable pressing surface.

17. A fabric care appliance system as in claim 15, further comprising a steam generator, the steam generator including a second heating element that is distinct from the first heating element.

18. A fabric care appliance system as in claim 17, wherein the first heating element comprises a PTC heating element.

19. A fabric care appliance system comprising:

an appliance body including;

a heatable pressing surface;

a first heating element configured to heat a heatable pressing surface;

a steam outlet which does not pass through a heatable pressing surface and is configured to emit steam from the appliance, wherein said heatable pressing surface is in fixed relation with the steam outlet, and a second heating element configured and arranged to generate steam without heating a heatable pressing surface, the second heating element being distinct from the first heating element.

20. A fabric care appliance system as in claim 19, wherein the steam generator is included in the appliance body.

21. A fabric care appliance system as in claim 19, wherein the first heating element comprises a PTC heating element.

22. A fabric care appliance system as in claim 19, further comprising a steam-permeable fabric over the steam outlet.

23. A fabric care appliance system comprising:

an appliance body including:

a steam outlet configured to emit steam from the appliance;

a heatable pressing surface separated in fixed relation from the steam outlet, wherein the heatable pressing surface and the steam outlet are constructed and arranged such that when the heatable pressing surface is contacted to a fabric surface, the steam outlet is positioned at a distance from the fabric surface and pointed toward the fabric surface; and a first heating element configured to heat the heatable surface;

wherein the heatable pressing surface has a width and a height, with the width being larger than the height, wherein the steam outlet is positioned adjacent to the width of the heatable pressing surface.

* * * * *